US007048056B1

(12) United States Patent
Blake

(10) Patent No.: US 7,048,056 B1
(45) Date of Patent: May 23, 2006

(54) DOWN-HOLE WELL CLEANING TOOL

(76) Inventor: Mark A. Blake, #27 Montgomery Rd., Gillette, WY (US) 82716

( * ) Notice: Subject to any disclaimer, the term of this patent is extended or adjusted under 35 U.S.C. 154(b) by 0 days.

(21) Appl. No.: 10/638,816

(22) Filed: Aug. 11, 2003

(51) Int. Cl.
*E21B 37/00* (2006.01)

(52) U.S. Cl. ..... 166/312

(58) Field of Classification Search ..... 166/312, 166/99, 157; 175/213, 320
See application file for complete search history.

(56) References Cited

U.S. PATENT DOCUMENTS 2,290,141 A * 7/1942 Burt ..... 166/312
2,946,565 A * 7/1960 Williams ..... 166/264
4,223,747 A * 9/1980 Marais ..... 175/65
4,630,691 A * 12/1986 Hooper ..... 175/65
5,069,285 A 12/1991 Nuckols ..... 166/311
5,158,140 A 10/1992 Ferry ..... 166/312
5,269,384 A 12/1993 Cherrington ..... 175/53
6,250,389 B1 6/2001 Sudol ..... 166/312

* cited by examiner

*Primary Examiner*—David Bagnell
*Assistant Examiner*—Daniel P. Stephenson
(74) *Attorney, Agent, or Firm*—Marsh Fischmann & Breyfogle LLP

(57) ABSTRACT

A down-hole well tool is disclosed for removing debris from a well utilizing low pressure/suction. More particularly, the tool is adapted to generate the low pressure within a well bore for removing debris while being interconnectable to the end of a single duct tubing that extends to the surface. Use of the low pressure/suction allows removal of debris without of forcing such debris into the permeable formations of the well. In one application, the tool may be utilized during open-hole completion processes. In another application, the tool may be utilized to clean existing wells.

9 Claims, 10 Drawing Sheets

DOWN-HOLE WELL CLEANING TOOL

FIELD OF THE INVENTION

The present invention relates to a down-hole well tool utilized for removing debris from a well bore hole and/or a surrounding formation. More particularly, the present invention is directed to a down-hole well tool adapted for interconnection to single duct tubing (e.g., drill pipe) that is operative to remove material and/or debris from a well by creating a suction within an isolated section of the well bore. Use of the tool to clean or complete a well allows for enhanced the production capacity of the well.

BACKGROUND

The production of methane gas from subterranean coalbeds has become a common practice in recent years. In this regard, coalbeds that contain absorbed hydrocarbon gases (i.e., primarily methane) can be produced by the way of well bores drilled and completed into the coalbed formations (i.e., coal seams). The majority of methane gas contained within coalbed formations is absorbed into micropore and macropore systems within the coal. The micropore system is contained within the coal matrix while the macropores represent cleats within the coalbed formation. These cleats are interspersed throughout the coal matrix forming a fracture system that accounts for a majority of the permeability through the coalbed formation. In order to extract methane gas from a subterranean coalbed, a well is drilled into the coalbed formation that allows the methane gas to permeate through the cleats and into the well bore. This may require de-watering of the well.

Typically, wells (i.e., water, in-situ, gas, etc.) are completed by inserting a casing (e.g., steel or PVC) into the well bore extending into the earth. This well bore casing may be secured within the well bore by packing a permeable material, such as gravel, between the casing and the well bore. In this instance, the casing may include perforations in the section of the well bore that passes through a permeable formation of interest (e.g., an aquifer or coalbed). The perforated casing allows a fluid of interest (e.g., water or gas) within the permeable formation to permeate into the well bore where it may be extracted. Alternatively, a subterranean section of the casing in the permeable formation may be removed to allow the fluid to enter the well.

The removal of a subterranean section of the casing, or the expansion of a well bore diameter beneath the bottom of a well casing, is commonly referred to as an "open-hole" well completion. In this regard, a well bore casing is placed within the well and cemented into place. After the cement has cured, an under-reaming tool is placed down the bore of the casing in order to cut out a desired section of the casing (e.g., the section of the casing within a permeable formation). Once the casing within the permeable formation is removed, fluid from that formation may permeate directly into the well bore. Alternatively, a section of the well beneath the bottom of the casing (e.g., in a permeable formation) may be expanded in diameter using such an under-reaming tool, which again allows a fluid to permeate directly into the well bore. For example, methane gas in a permeable coalbed may permeate through cleats that are in communication with the open-hole section of the well. One benefit of the open-hole completion is that the under-reaming tool is able to create a section within the well having an increased diameter thereby increasing the interface with the permeable formation. In the case of coalbed methane gas wells, this allows additional cleats within the coalbed to communicate with the well, which allows for increased gas production.

Disadvantages of open-hole completion include the deposition of debris in the well bore during the under-reaming process and the lack of structure within the resulting open-hole section of the well bore. In this regard, the sides of the open-hole section may slough depositing debris (sometimes referred to as fines) in the well. Over time, this debris may accumulate within the open-hole section of the well bore and may clog or otherwise blocked the cleats thereby interfering with the production of gas from the well. Accordingly, this reduces the well's productivity.

In order to maintain the production of methane gas wells, it may be necessary from time to time to clean the well bore. Heretofore, this has entailed flushing the well wherein a pipe is inserted to the bottom of the well that applies fluid pressure (e.g., air, water or drilling fluids) in order to carry the debris to the surface.

SUMMARY OF THE INVENTION

The present inventor has realized that current methods utilized for open-hole completion and cleaning of coalbed methane gas wells result in the application of high pressures to the permeable coalbed formations. Furthermore, the inventor has recognized that this pressure has the effect of forcing debris in the well bore into the cleats, which reduces the permeability of the coalbed and thereby results in a reduced overall production capacity for the well. To address this issue, the inventor has recognized the desirability of removing debris during open-hole well completion and well cleaning procedures utilizing low pressure and more preferably suction. While systems exist for creating suction within a well bore, such systems utilize dual walled conduits (e.g., double walled pipe) wherein each conduit extends from the surface into the well. In this regard, a first conduit carries a fluid into the well and a second conduit carries the fluid out of the well. Such dual walled conduits are typically very heavy, limiting the depth of wells that may be serviced. In this regard, the inventor of the present invention has developed a tool interconnectable to the end of a single conduit pipe for disposition in a well that is operable to create a low pressure area (i.e., suction) within a section of the well bore while still evacuating debris to the surface.

According to a first aspect of the present invention, a well tool designed to be inserted into a well on the end of a single duct tubing is provided. Once placed in a well, the tool substantially isolates first and second sections of the well such that the first section (e.g., a lower section) is maintained at a low pressure for use in removing debris while a second section (e.g., an upper section extending to the surface) may be maintained at a higher pressure for carrying debris to the surface. The tool includes first and first and second conduits, one of which is in fluid communication with the single duct tubing that extends to the surface. In this regard, one conduit (e.g. the first conduit) may receive a fluid flow from the surface. A fluid transfer port interconnects the first and second conduits. This fluid transfer port discharges the fluid flow through the first conduit into the second conduit (e.g., upwardly) in order to generate the low pressure area within the first section (i.e., lower section) of the well. A casing collar, disposed along the length of the first and second conduits, forms a pressure barrier, which maintains a pressure gradient between the first and second sections of the well. In order to transfer debris out of the well, the second conduit has an input port below the casing collar and an output port above the casing collar. In this regard, the second conduit forms a transfer conduit through the casing collar. The fluid flow between the first and second conduit also creates a suction at the inlet of the second conduit, which draws debris from the well into the second conduit. The fluid flowing through the second conduit, including any debris, is discharged through the output port above the casing collar (e.g., into the well bore casing) where it may continue to the surface. As will be appreciated, this allows removal of debris and/or fluid (i.e., effluent) beneath the casing collar without the application of high pressures to the well beneath the casing collar, which may clog permeable formations.

Various refinements exist of the features noted in relation to the subject first aspect of the present invention. Further features may also be incorporated in the subject first aspect of the present invention as well. These refinements and additional features may exist individually or in any combination. For instance, the tool may include various fittings that allow its interconnection to the single duct tubing (e.g., drill pipe). Such fittings may include, for example, threaded collars for engaging a threaded drill pipe as well as grips that allow the tool to be supported within in a rotary table of a drilling rig (e.g. to facilitate interconnection/disassembly from such a drill pipe). Furthermore, it will be noted that while the tool is typically interconnected to a rigid single duct drill pipe, other tubing may be utilized. For example, in shallow well applications the tool may be interconnectable to a single duct flexible tubing (e.g., polypipe). What is important is that the single duct tubing is operative to support the tool within a well bore and supply a fluid flow to the tool.

The fluid transfer port may be any orifice interconnecting the first and second conduits that effectively transfers a fluid flow from the first conduit (i.e., a supply conduit) to the second conduit (i.e., a transfer conduit) while producing an area of low pressure. Typically, the port will have a reduced cross sectional area in comparison with the cross-sectional area of the first conduit. In this regard, when fluid flows through the fluid transfer port its velocity is increased thereby causing a low pressure area. In effect, the fluid transfer port creates a Venturi nozzle or jet port. Furthermore, a plurality of such fluid transfer ports may be utilized so long as they are operative to increase the velocity of the fluid flow between the first and second conduits.

To utilize the low pressure area to remove debris from a well, the casing collar disposed along the length of the first and second conduits substantially isolates the first and second sections of the well. In this regard, the section beneath the casing collar is exposed to the low pressure/suction created by the fluid transfer port while the section of the well above the casing collar is utilized to transport the fluid and any ingested debris to the surface. In this regard, the shape of the collar may be substantially similar to the shape of the well bore (e.g., round). That is, the outside diameter of the collar may be substantially the same as the inside diameter of the well bore. However, it will be appreciated that the collar may be slightly smaller than the inside diameter of the well bore such that the tool may be easily inserted and moved throughout the well. Furthermore, the collar may utilize a resilient material about its outside surface to create a seal with the inside surface of the well bore. In one embodiment, the output port of the second conduit is located proximate to the casing collar such that a second low pressure area may be created within the well. This second low pressure area may be formed relative to the interface between the casing collar and the inside surface of the well bore. In this regard, fluid beneath the casing collar is drawn thereby further reducing the pressure in the section of the well beneath the casing collar.

The first and second conduits are typically operative to conduct fluid (e.g., upward or downward) over a majority of their length. In this regard, the conduits are, in general, substantially parallel over their entire length. For example, the conduits may be first and second pipes disposed side-by-side for carrying fluid downward and upward over the length of the tool. In one embodiment, these first and second conduits comprise first and second concentrically aligned pipes. Furthermore, the first and second conduits may have any cross-sectional configuration so long as they are capable of effectively transferring the amounts of fluid required to create suction within the well.

It is preferred that the fluid transfer port(s) that interconnects the first and second conduits be near the bottom end of these conduits at a point below the casing collar. This allows the generated low pressure/suction to be better communicated with the lower section of the well. However, the fluid transfer port may interconnect the first and second conduits at a point above the casing collar. Likewise, the inlet port of the second conduit is preferably located near the fluid transfer port such that suction created by the fluid transfer port is better able to draw debris and/or fluids within the lower section of the well into the second conduit. It will be appreciated that the location of the fluid transfer port as well as the inlet and outlet ports of the second conduit may be modified. However, in any embodiment the casing collar is disposed between the inlet and outlet port of the second conduit.

A well drilling implement may be interconnected to a bottom end of the tool to perform under-reaming, cleaning and/or further drilling. In this regard, the depth or diameter of a well may be enhanced under a low pressure or even negative pressure, which may allow for enhanced production from that well. In order for such a drilling implement to properly function, the first conduit may further include an output port through the bottom of the tool that is in fluid communication with the drilling implement. In this regard, a portion of the fluid flow from the surface may pass through the tool.

According to a second aspect of the present invention, a method for removing debris from a well is provided. The method includes the steps of forming a barrier at a subterranean point of interest within a well bore that substantially isolates the well above and below the point of interest. A fluid is injected downward into the well through a first conduit from a source on the surface. This fluid is discharged from the first conduit into a second conduit. Importantly, the velocity of the fluid flow is increased upon discharge from the first conduit to the second conduit in order to create a low pressure area. Furthermore, this low pressure area is at least partially exposed to the well beneath the barrier. In this regard, debris and/or fluid in the well below the barrier and proximate to the low pressure may be drawn into the fluid flow through the second conduit. Accordingly, the fluid flow and any debris included therein may be discharged above the barrier where it may continue upwardly to the surface.

Variations exist to the features noted in relation to the subject second aspect of the present invention. For example, the step of injecting the fluid may comprise injecting high pressure gas into the well bore. However, other fluids such as water and/or drilling mud may also be utilized. As will be appreciated, higher viscosity fluids (e.g., drilling mud) may allow for the removal of larger debris from the well.

Forming a barrier within the well typically entails filling (i.e., substantially) a section of the well bore with a structure such that a pressure gradient may be supported across that structure. This may further entail forming a seal with in inside surface of the well bore casing. While the barrier may be established within a cased section of a well, the method also allows for removal of debris from non-cased, open hole sections of a well, as will be discussed herein. In any case, the barrier will allow for transfer thereby of effluent (e.g., fluids and debris) through a transfer conduit. In this regard, effluent may be suctioned into a transfer conduit beneath the barrier and discharged above the barrier. Typically, the effluent will be discharged above the barrier into a well bore casing.

The downwardly flowing fluid supplied from the surface is re-directed upwardly to carry effluent to the surface. This may be done in conjunction with discharging the fluid from the first conduit to the second conduit, though this is not a requirement. To enhance removal of debris from the well bore, the well bore may be disturbed. For example, a portion of the fluid flow from the surface may directed into the well bore beneath the barrier. In this regard, a fluid stream from a nozzle or a drilling implement may engage a side surface of the well bore. In one embodiment, such a fluid flow is utilized to operate an under-reaming device. The under reaming device may also rotate to remove a sidewall section of the well bore (e.g., casing and/or a portion of a formation) beneath the barrier. Accordingly, debris created by this process is removed as discussed above. Furthermore, the method may include moving the barrier up and down the well bore such that an elongated section of the well bore may be exposed to the area of low pressure. In this regard, long subterranean sections of a well may be cleaned or removed.

DETAILED DESCRIPTION

The present invention is directed towards a down hole well completion and cleaning tool that is particularly apt for methane gas well production. In this regard, the tool of the present invention may be utilized for completion and cleaning of methane gas wells that may contain one or more open-hole production sections in one or more subterranean coalbeds. However, it will be appreciated that certain aspects of the present invention are not so limited. For example, the well tool of the present invention may also be utilized to clean wells (e.g. water wells, oil wells, in-situ wells, etc.) that utilize fully cased well bores having one or more sections of perforated casing.

The well tool of the present invention is operative to create an area of low pressure within a well bore for use in evacuating debris from the well during well drilling, completion and/or cleaning procedures. This low pressure substantially reduces or eliminates the application of pressure to the well bore that may clog or otherwise damage permeable formations (e.g., coalbeds) in communication with the well bore. Initial tests of the well tool discussed herein indicate that production of methane gas wells completed utilizing the low pressure/suction provided by this tool may be substantially greater than wells completed using existing high pressure systems (e.g., 25–100% greater).

Of particular note, the well tool disclosed herein is operable to create an area of low pressure in a subterranean section of a well while being interconnected to the surface using a single duct conduit. This conduit, typically a drill pipe, may be interconnected to the tool and extend downward to a desired location within the well for completion and/or cleaning purposes. As will be appreciated, the maximum well depth that a given servicing unit (e.g., drilling rig) can service is dependent upon the weight of the drill string (i.e., the connected sections of drill pipe extending into the well). In this regard, all previously known processes wherein a low pressure is created within a well bore require the use of dual walled drill pipe having a first conduit for carrying fluid flow in a first direction (e.g., down the well bore) and a second conduit for carrying fluid in a second direction (e.g., up the well bore). Such dual walled pipe is considerably heavier than a comparably sized (e.g., outside diameter) single conduit drill pipe. For example, a dual walled pipe may weigh about 25 lbs. per linear foot whereas comparably sized single walled pipe may weigh about 10 lbs. per linear foot. Accordingly, a servicing unit that utilizes single walled pipe may service wells up to about 2.5 times as deep as a servicing unit that utilizes dual walled pipe.

Figure 1:
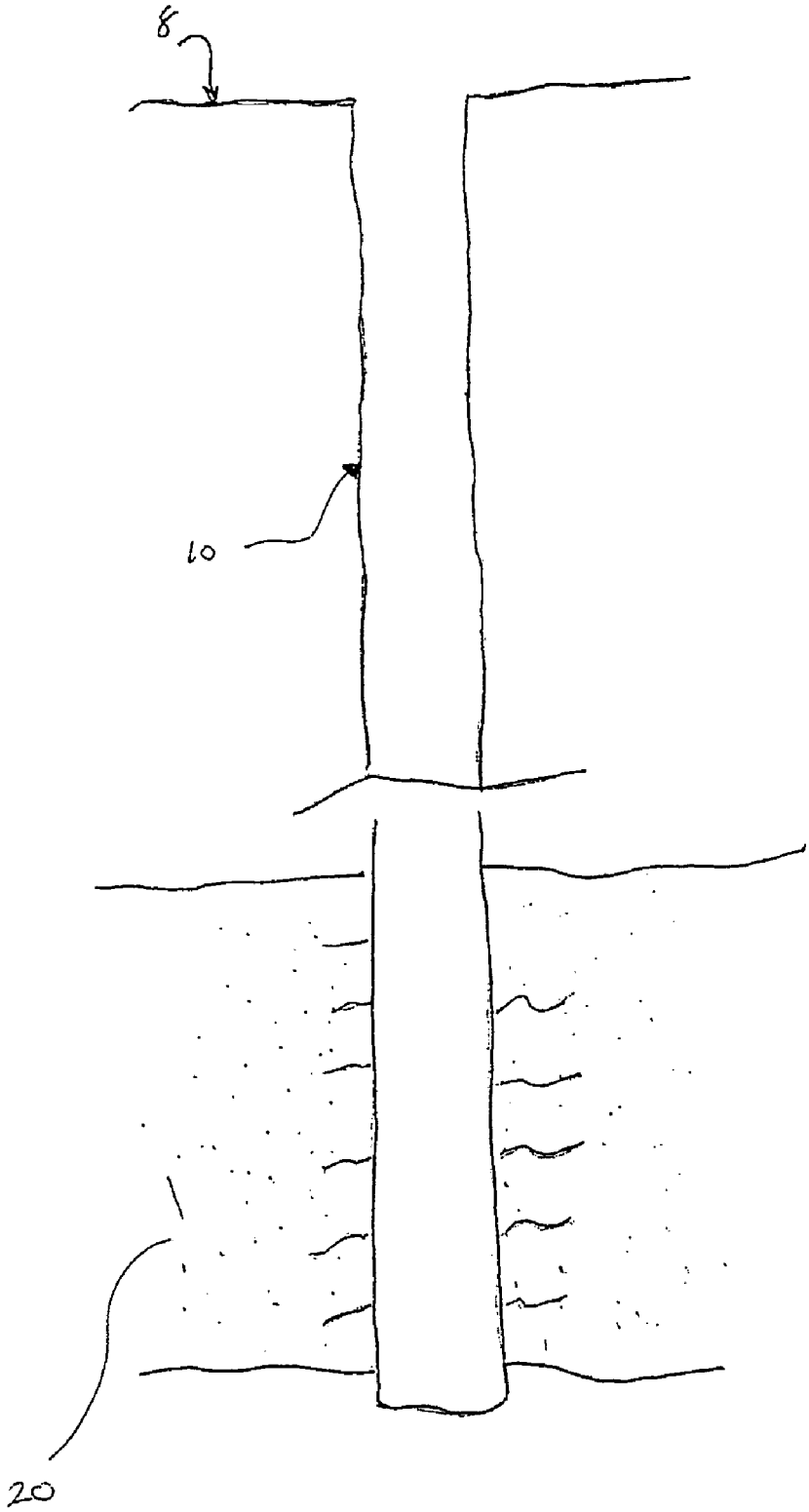
FIG. 1 shows a well bore.
Figure 2A:
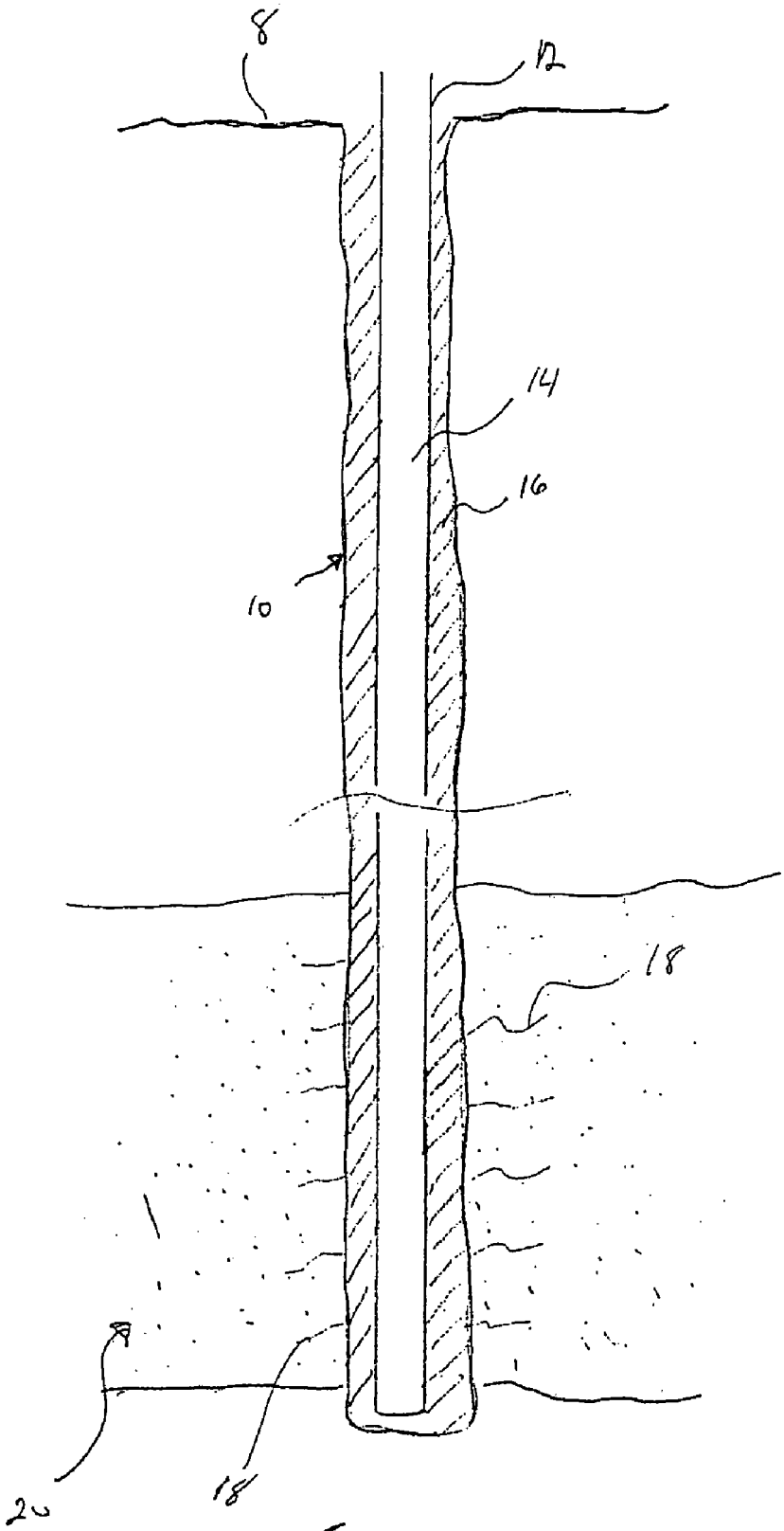
FIG. 2*a* shows a fully cased well bore.
Figure 2B:
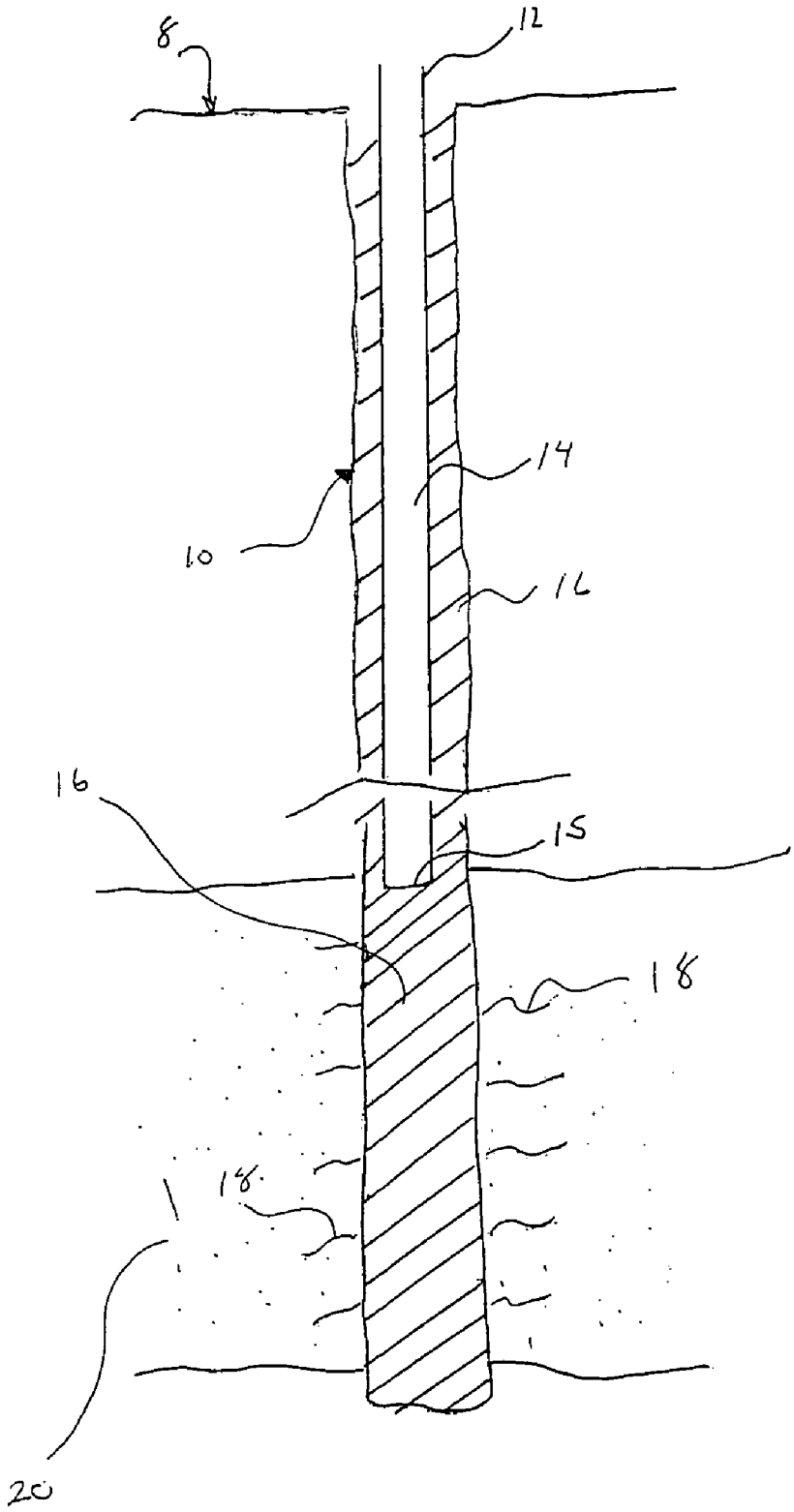
FIG. 2*b* shows a top cased well bore.
Figure 3:
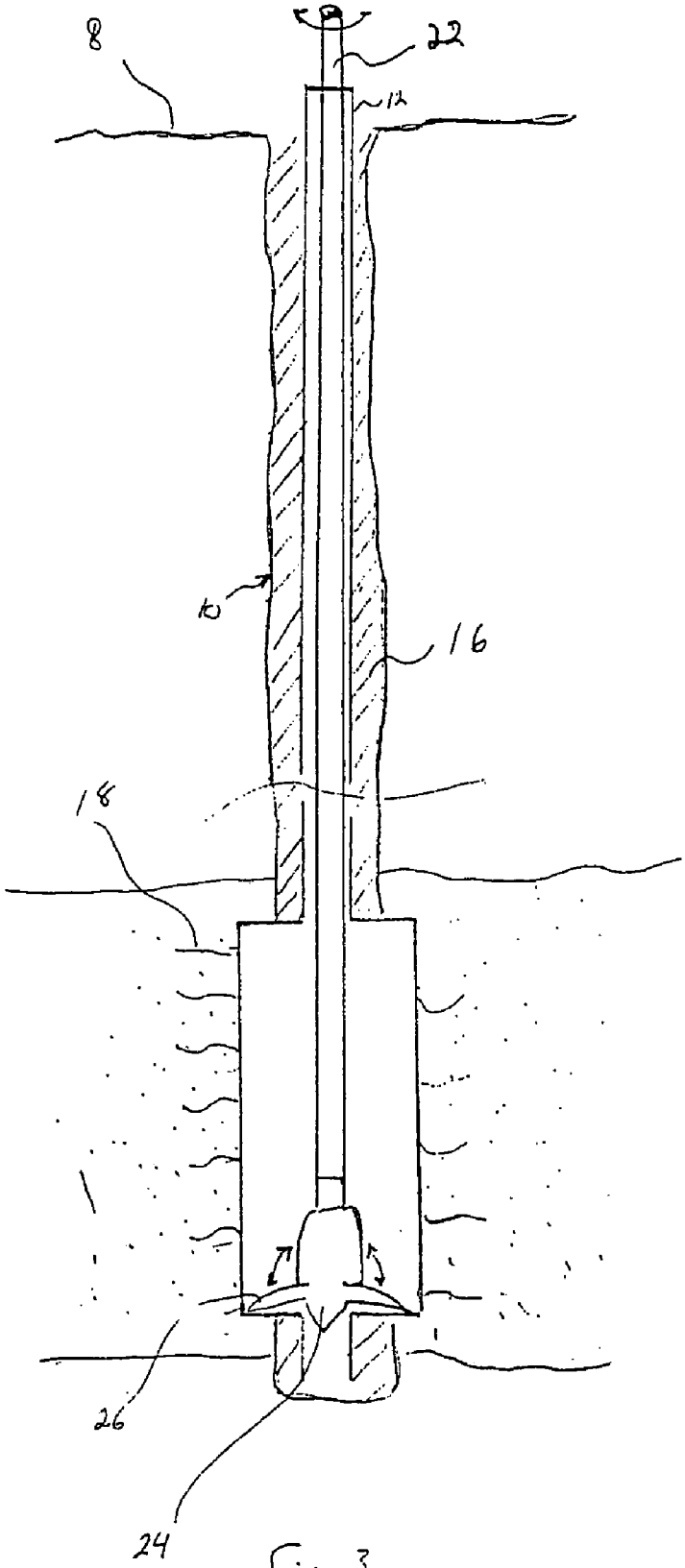
FIG. 3 shows an under-reaming process.
Figure 4:
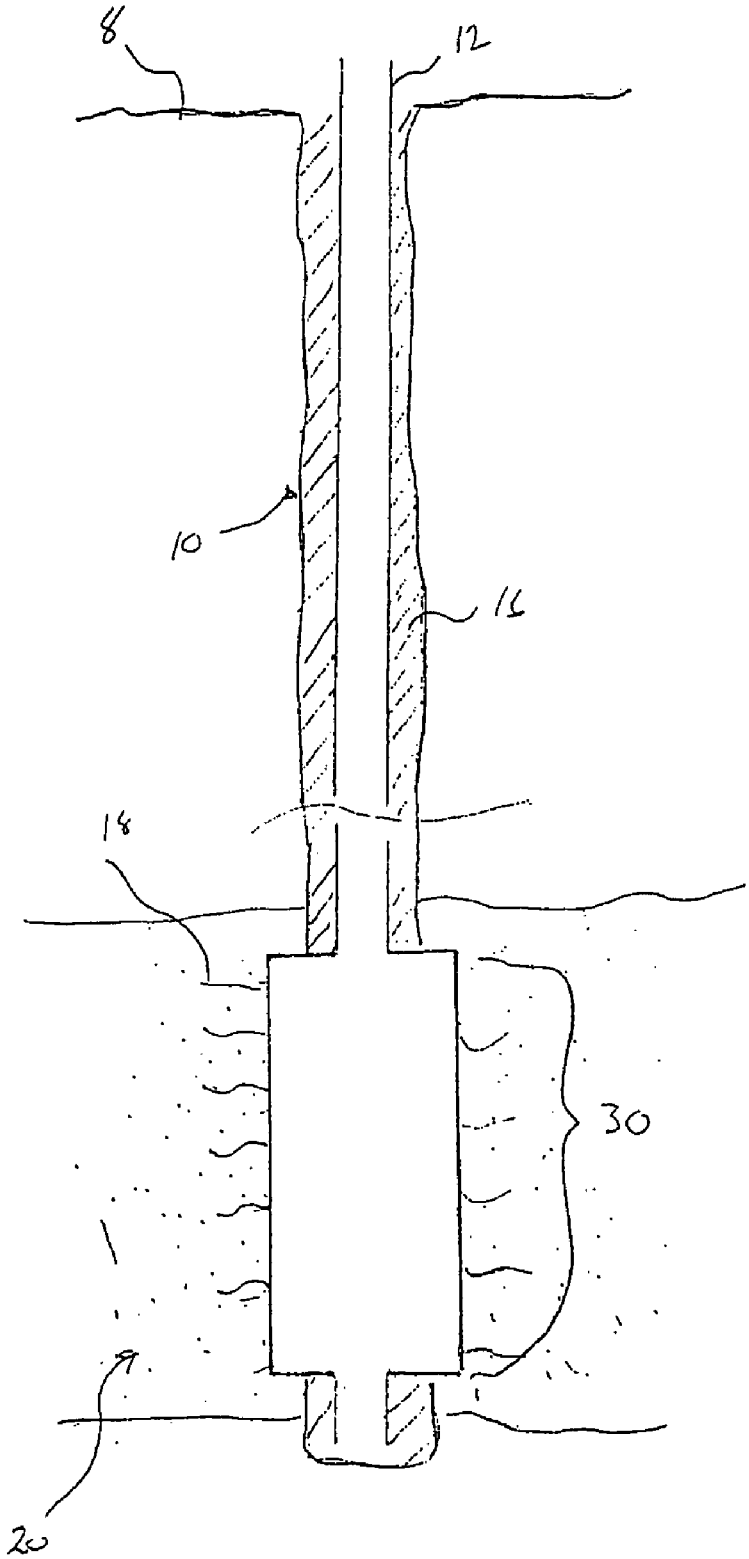
FIG. 4 shows an open-hole completed well bore.

FIGS. 1–5 illustrate the drilling and open-hole completion of a methane gas well. As shown in FIG. 1, a well bore 10 extends from the surface 8 into the earth and through a coalbed 20. Such well bores 10 may be relatively shallow (e.g., 100 feet), or may extend several thousand feet into the earth. The well bore 10 may be drilled utilizing any variety of known methods. Typically, such well bores 10 are drilled utilizing a rotary table drilling system. However, other processes (e.g., augur-type drilling) may also be utilized. What is important is that the well bore 10 extends through one or more coalbeds 20.

Once the well bore 10 is completed to the desired depth, a casing 12 (e.g., steel or PVC pipe) is placed into the well bore 10 that extends from the surface 8 to or near the bottom of the well bore 10. See FIG. 2*a*. In this regard, a plurality of interconnected casing joints (e.g., 20 ft. sections) may be utilized. Alternatively, a top set casing may be utilized. In this regard, the bottom 15 of the casing 14 is disposed near the top of the coalbed 20. See FIG. 2*b*. In either case, after the casing is disposed in the well bore 10, cement is forced through the central casing bore 14 of the casing 12, out the bottom of the casing 12, and back to the surface 8 in order to fill the void between the casing 12 and the well bore 10 with cement. Once the void between the casing 12 and the well bore 10 is filled with cement 16, the cement 16 remaining within the central casing bore 14 is displaced with water (e.g., a known volume of water is utilized to displace the cement within the bore of the casing 12). At this time, the cement 16 is allowed to cure sealing various formations (e.g., aquifers) in the earth from the well. To provide access between the well and the permeable cleats 18 within the coalbed 20 to produce methane gas from the well, the casing 12 and/or the cement 16 within the coalbed 20 is removed.

Heretofor, removal of the casing 12 and/or cement 16 within the coalbed 20 was performed under high pressure utilizing an under-reaming tool 24 interconnected to the end of a drill pipe 22. See FIG. 3. In this regard, the drill pipe 22 and the interconnected under-reamer 24 are lowered down through the casing 12 until the under-reamer is located within the coalbed 20. As will be appreciated, the location of the subterranean coalbed 20 may be determined through data obtained during the drilling process or through well logging procedures performed after the well bore 10 has been drilled. In any case, once the under-reaming tool is properly positioned relative to the coalbed 20, the drill pipe 22 and under-reamer 24 are rotated in conjunction with fluid pressure being applied through the drill pipe 22. This fluid (e.g., water, drilling mud, or air) is forced through the drill pipe 22 and through the under-reamer 24. The pressure applied to the under-reamer forces opposing blades 26 contained within the under-reamer 26 into an outward position. These blades 26, coupled with the rotation of the drill pipe 22 and under-reamer 24 cut through the casing 12 and cement 16 (e.g., as in FIG. 2*a*) or through the cement 16 (e.g., as in FIG. 2*b*) and into the coalbed 20. In the case of the top set casing of FIG. 2*a*, the under reamer may include a drill point for drilling through cement within the well bore. In either case, the flow of fluid through the drill pipe 22 evacuates the majority of the removed material up the casing bore 14 to the surface 8.

Once the under-reaming process is completed, the coalbed 20 is in direct communication with the casing bore 14 through what is typically termed an "open-hole" section 30 of the well. See FIG. 4. In this regard, the cleats 18 within the coalbed 20 extend directly into the open-hole section 30 of the well such that methane gas contained within the coalbed 20 may be extracted. As will be appreciated, the under-reaming process provides a section 30 within the coalbed 20 having an enhanced diameter thereby allowing additional cleats 18 within the coalbed 20 to communicate with the well.

Figure 5:
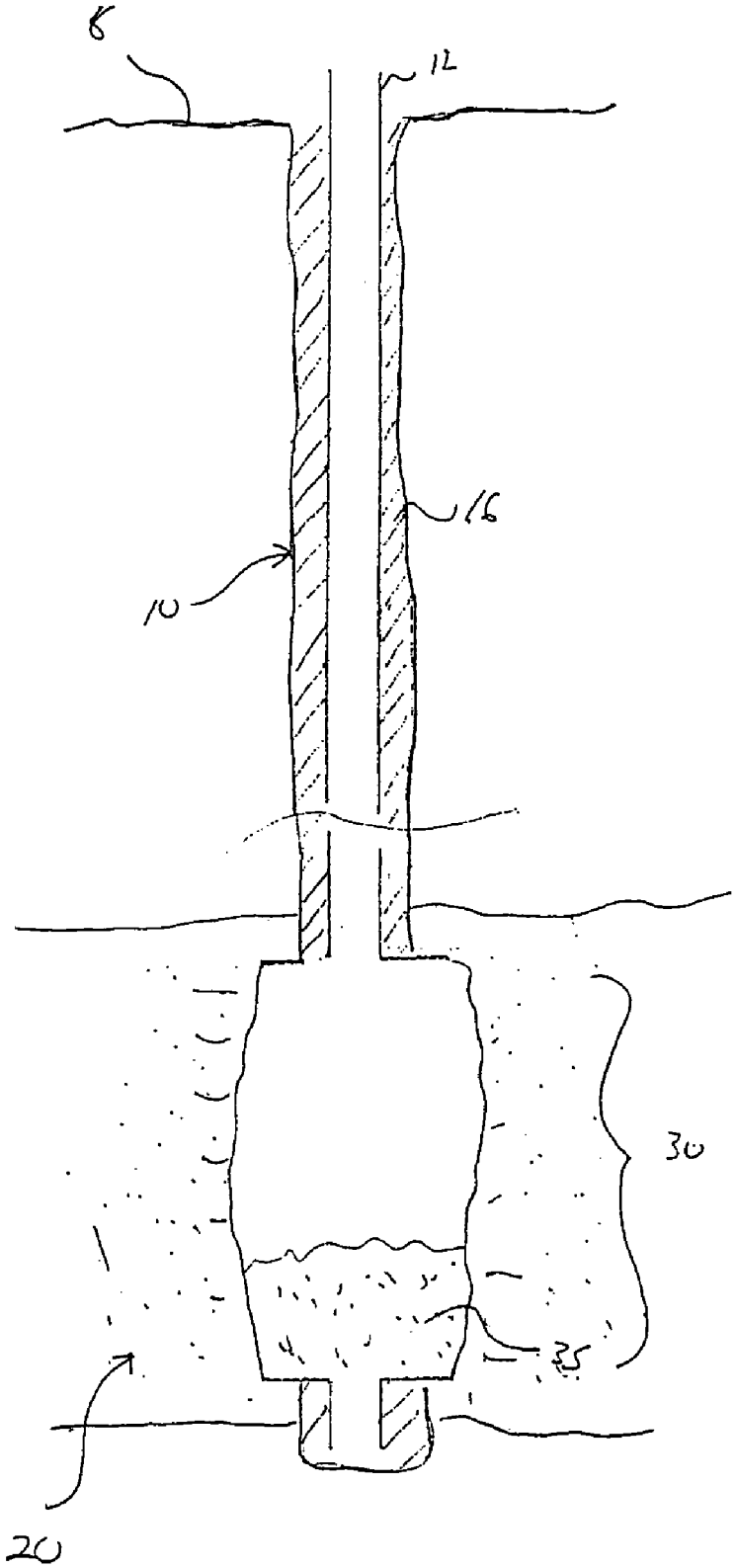
FIG. 5 shows a second open-hole well bore.

While enhancing the diameter of the well within the coalbed 20, the pressurized fluids utilized to evacuate the removed debris from the well during under-reaming may affect the cleats 18 within the coalbed 20. That is, the pressure applied during under-reaming may force debris into the cleats 18. This may damage the cleats 18, reducing the production capacity of the well. Furthermore, as shown in FIG. 5, the walls of the open-hole section 30 may, over time, slough and deposit debris within the bottom of the well. If this debris accumulates, the overall production from the gas well may be reduced. Accordingly, from time to time it may be necessary to remove this debris from the well (i.e., clean the well) to maintain production.

One option for removing debris from a well bore 10 is to insert a drill pipe 22 into the well bore 10 and apply a fluid flow (e.g., air or water) to flush out the well. This type of pressurized flushing of the well bore 10 applies high pressures to the production section of the well. This high pressure may drive debris into the cleats 18 of the coalbed 20, thereby clogging or otherwise damaging the ability of the cleats 18 to communicate methane gas to the open-hole section 30 of the well bore 10. Accordingly, a method to remove debris from a well bore 10 during completion and/or cleaning without applying undue pressure to the permeable coalbed 20 is desirable.

Figure 6:
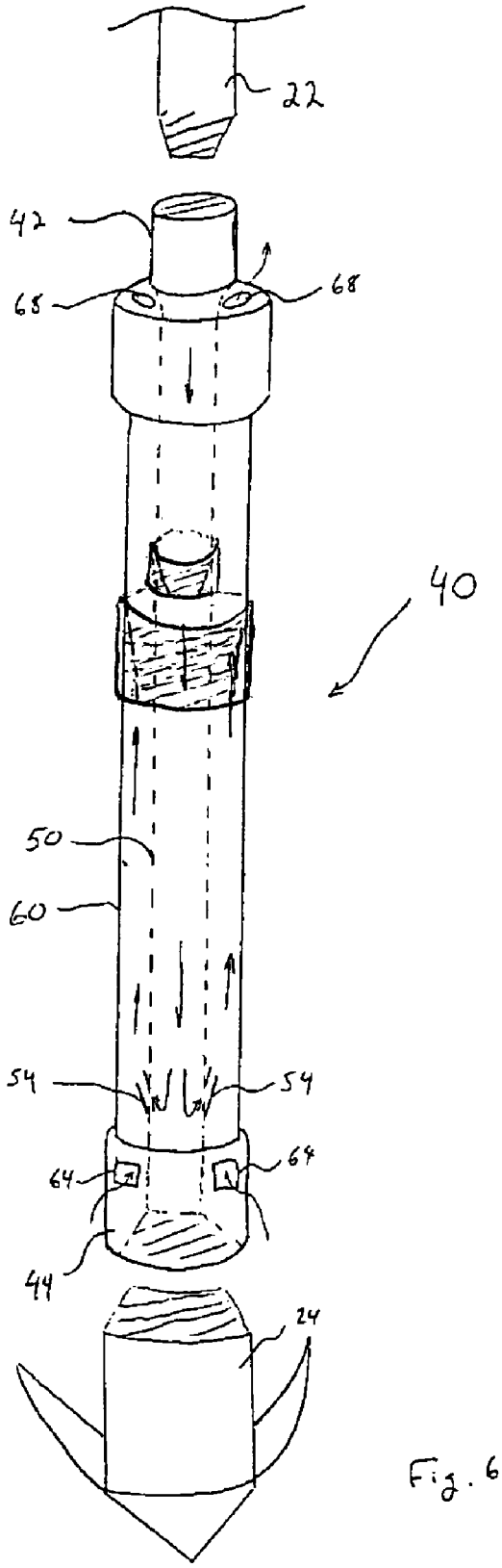
FIG. 6 shows a perspective view of the well tool of the present invention.
Figure 7:
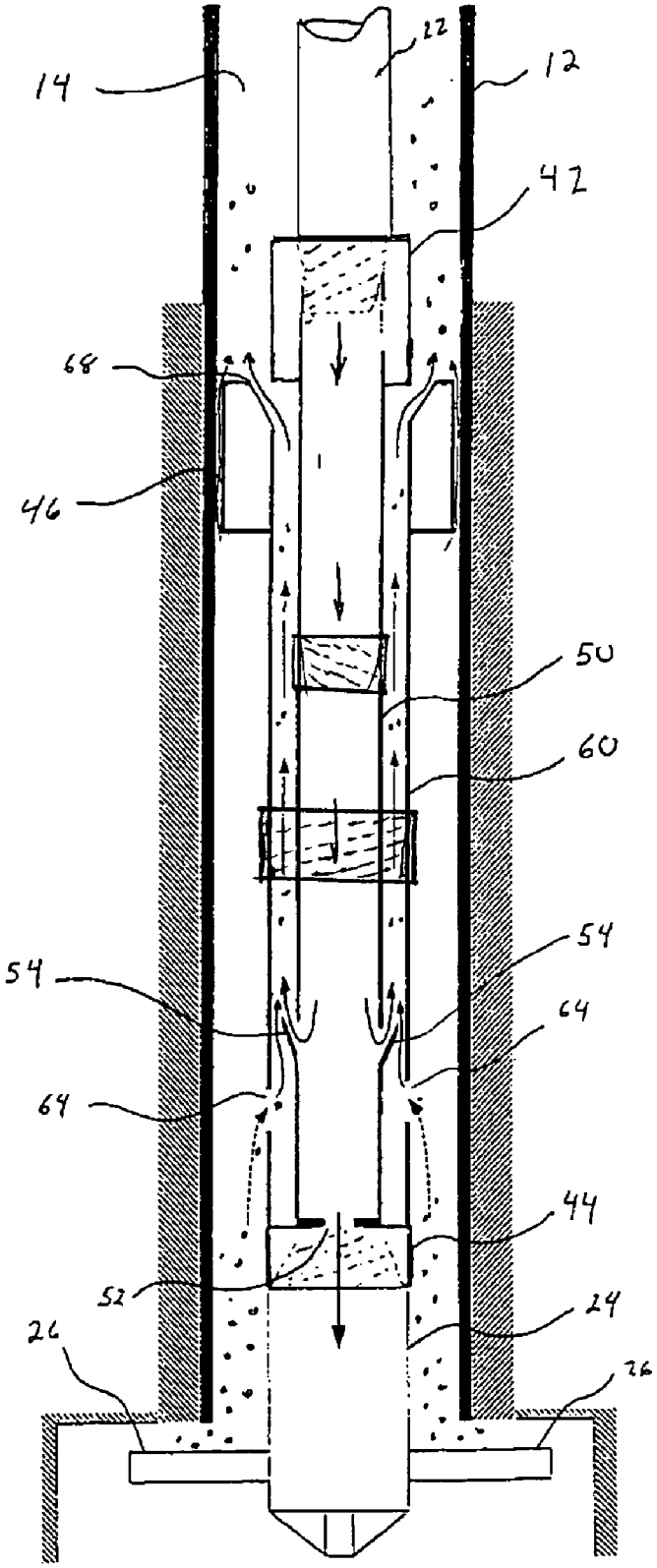
FIG. 7 shows a cross-sectional view of the well tool of FIG. 6 placed within a well bore.

FIGS. 6 and 7 shows a perspective view and cross-sectional view, respectively, of the well tool 40 that is operative to remove debris from a well by creating a low pressure within a desired section of the well bore. As shown, the well tool 40 has an elongated body that is sized for insertion within the bore 14 of the well casing 12. The top end of the tool 40 includes a threaded collar 42 for interconnecting the tool 40 to a threaded drill pipe 22. In the embodiment shown, the tool 40 also includes a bottom threaded collar 44 that allows the tool 40 to be interconnected to additional well drilling implements such as additional piping 22, drill bits, or an under-reamer 24 as shown. In this particular embodiment, the tool 40 is interconnected with the under-reamer device 24, which allows the tool 40 to be utilized during the open-hole completion process described above. In this regard, an open-hole completion of a well may be performed without the application of high pressure to a permeable formation (i.e., coalbed 20).

The tool 40 includes two substantially parallel conduits 50, 60 that extend from the top end to the bottom end of the tool 40. As shown, the conduits 50, 60 comprise first and second concentrically aligned pipes, though this is not a requirement. The first conduit 50 (i.e., the inner pipe) is fluidly interconnected to the drill pipe 22 such that fluids from the surface 8 may pass downward through the drill pipe 22 and through the inner conduit 50. The outer conduit 60 includes one or more inlet ports 64 near the bottom of the tool 40 and one or more outlet ports 68 near the top of the tool 40. Of note, the inlet ports 64 are sized to prevent any debris from entering the tool 40 that may become stuck within the tool 40. That is, the inlet ports 64 are smaller than the space between the two conduits 50, 60 to prevent entry of debris that may become lodged between the conduits 50, 60. Likewise, the inlet ports 64 are smaller than the outlet ports 68 to ensure that debris that enters the tool 40 is able to exit through the outlet port 68.

The first and second conduits 50, 60 are interconnected utilizing one or more jet ports 54. These jet ports 54 are disposed near the bottom of the tool 40 and are operative to discharge a pressurized fluid (i.e., working fluid) received by the inner conduit 50 from the drill pipe 22 (e.g., originating from a surface such as a drilling rig on the surface 8) upwardly into the second conduit 60. That is, the jet ports 54 redirect the fluid upwards through the second conduit 60 and out the outlet port(s) 68. Once this pressurized working fluid passes through the outlet port 68, it continues in the space between the outside surface of the drill pipe 22 and the inside surface of the casing 12 to the surface 8 (i.e., within the casing bore 14).

The jet ports 54 operate on the Venturi principle. That is, the velocity of the fluid passing through the inner conduit 50 is increased by passing through the jet port(s) 54, which have a reduced cross-sectional area in comparison with the inner conduit 50. Accordingly, the increased velocity of the fluid flow creates a low pressure region between the outside surface of the inner conduit 50 and the inside surface of the outer conduit 60. In order to utilize this low pressure to remove debris from the well bore 10, the inlet ports 64 on the outer conduit 60 are disposed proximately to the resulting jet ports 54 and the low pressure zone. In this regard, debris on the outside of the tool 40 may be sucked into the outer conduit 60 and expelled through the outlet ports 68 for evacuation to the surface with the working fluid.

In order to provide a well tool 40 that creates a low pressure within a down hole section of a well bore 10 while utilizing a single conduit pipe 22 to interconnect the tool to the surface 8, the inlet ports 64 (i.e., at a low pressure) and the outlet ports 68 (i.e., at a high pressure) must be substantially isolated from one another, except for the fluid carrying conduits 50, 60. As will be appreciated, fluid and debris removed from the well to the surface 8 are evacuated through the casing bore 14 above the tool 40. Furthermore, this debris and fluid will necessarily be under pressure. To maintain a low pressure region relative to inlet port 64 of the well tool 40, the well tool 40 includes a casing collar 46 sized to provide a pressure barrier between the inlet ports 64 and the outlet ports 68. As shown in FIG. 7, the casing collar 46 is disposed near the top end of the tool 40. However, it will be appreciated that this casing collar 46 may be located at other locations along the length of the tool 40, so long as it separates the inlet port(s) 64 and outlet port(s) 68.

The casing collar 46 has an outside diameter substantially similar to the inside diameter of the casing 12. Though being substantially similar, it will be appreciated that the diameter of the casing collar 46 may be slightly smaller than the inside diameter of the well casing 12 such that the tool 40 may be inserted into and positioned within the well. In a further embodiment (not shown) this collar 46 may utilize a resilient wiper (e.g., a rubberized O-ring) to provide enhanced pressure isolation between the inlet and outlet ports 64, 68. However, the utilization of a casing collar 46 having a slightly reduced diameter relative to the inside diameter of the casing 12 may provide an additional reduction of pressure within the well beneath the casing collar 46. In this regard, when the casing collar 46 is disposed proximate to the outlet ports 68, a second Venturi effect is created. That is, as pressurized fluid is passed upwardly through the second conduit 60, it is forced through a reduced diameter outlet port 68, thereby increasing the velocity of the fluid and creating second a low pressure area. This second low pressure area is created near the interface of the casing collar 46 and the inside surface of the well casing 12. Accordingly, suction is created therebetween that helps evacuate fluids beneath the collar 46. See FIG. 7. This further reduces the pressure beneath the casing collar 46.

During open-hole completion procedures, a portion of the downward fluid flow from the surface 8 must pass through the tool 40 to open the blades 26 on the under reamer 24. Likewise, during cleaning procedures it may be preferable to disturb debris within the open-hole section 30 of the well bore 10 such that the debris may be better removed. In this regard, a portion of the fluid flow through the inner duct 50 may pass through a port 52 on the end of the tool 40 in order to open the blades 26 on the under-reaming device 24. Additionally, the tool 40 and under-reamer 24, may be rotated during the cleaning process. Furthermore, fluid flow through the end of the tool 40 may be utilized to displace debris with or without the use of an attached drilling implement. However, it will be appreciated that the pressure of this flow through the port 52 on the end of the tool 40 is preferably minimized to reduce the pressure applied within the open-hole section 30 of the well. In this regard, the port 52 may have a pressure and/or flow regulating insert.

Figure 8:
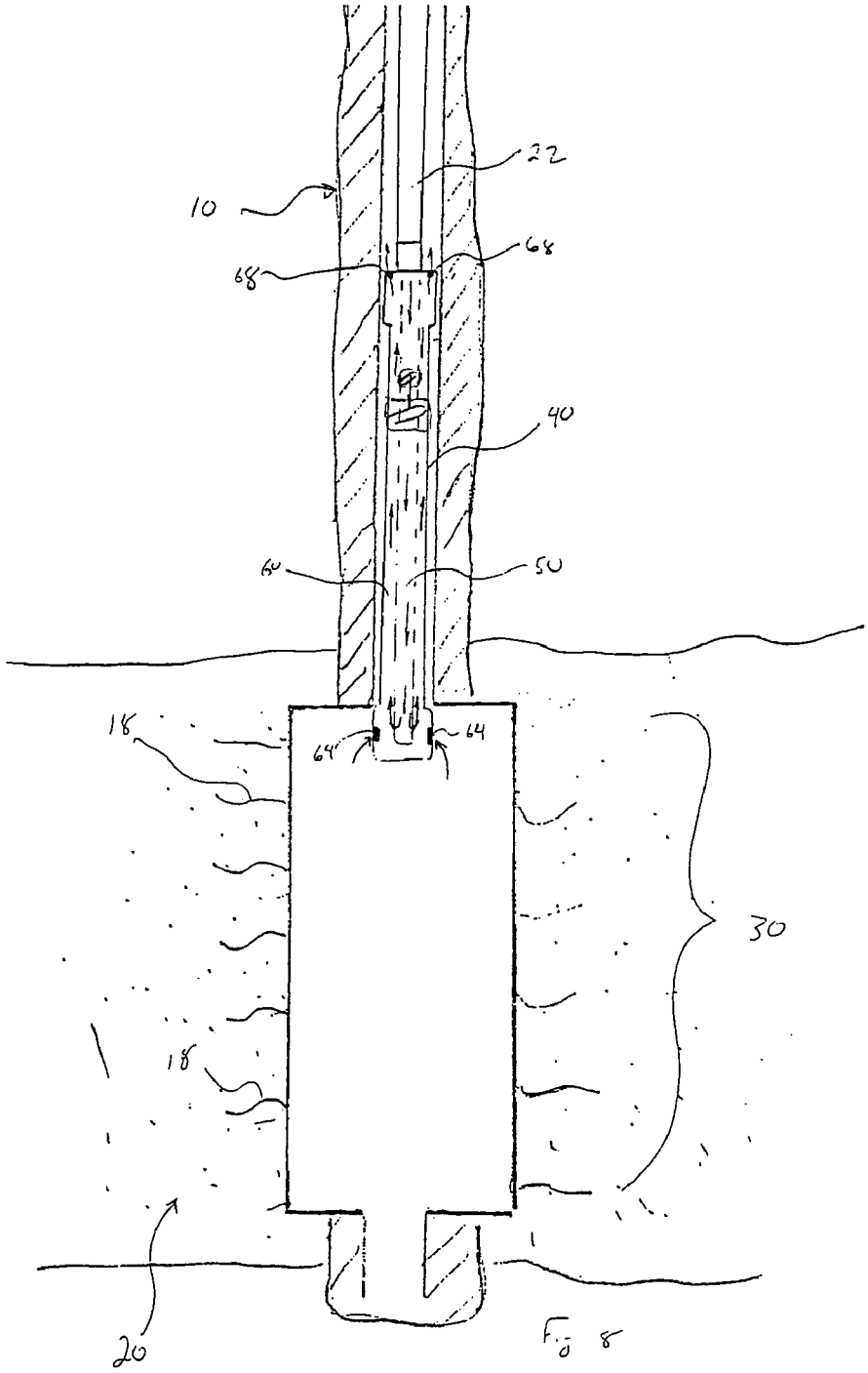
FIGS. 8 and 9 show the well tool of FIG. 7 being utilized to clean a well bore.
Figure 9:
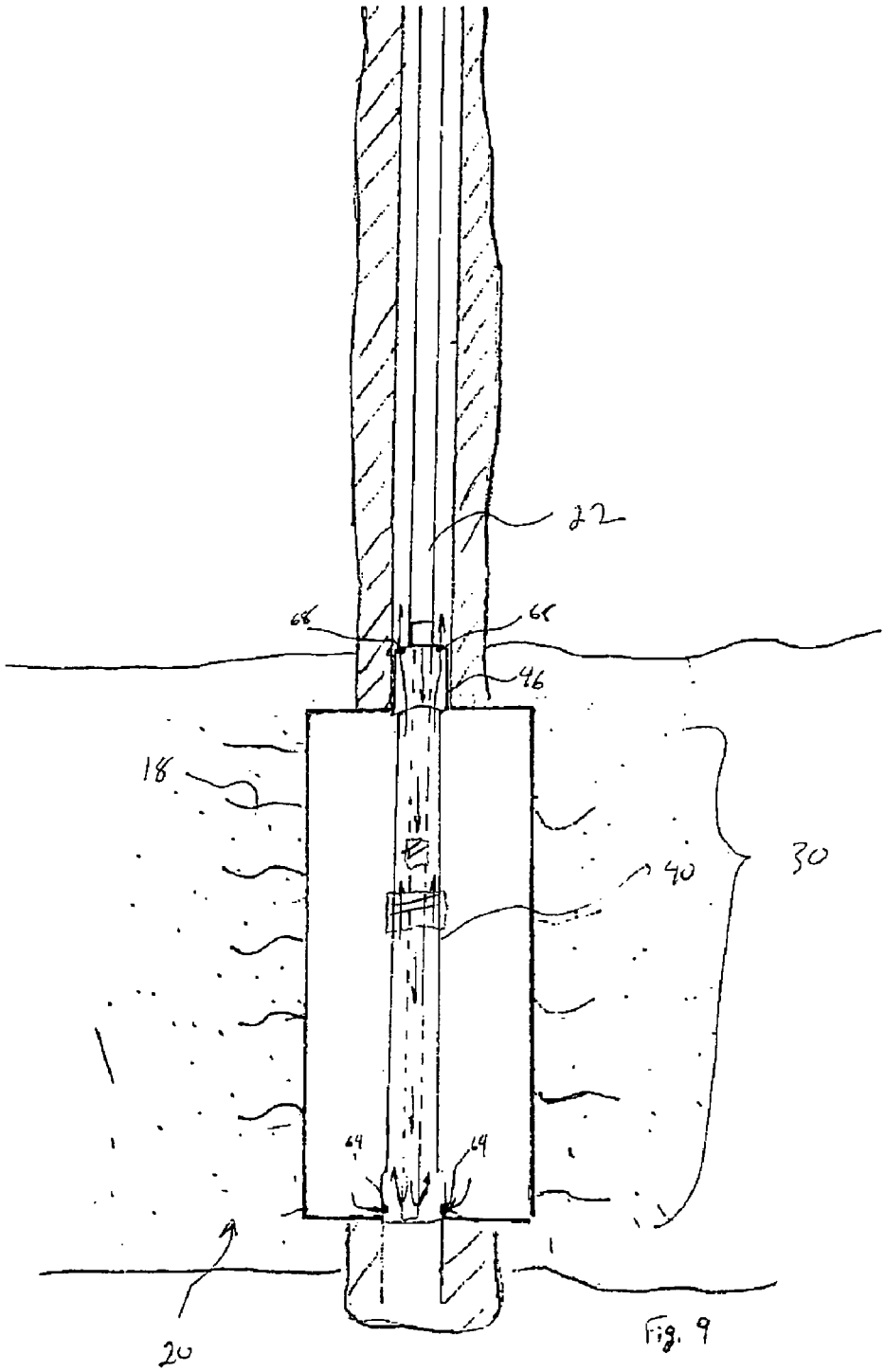

FIGS. 8 and 9 illustrate the utilization of the well clean out tool 40 to clean out an open-hole section 30 within a well bore 10. As shown in FIG. 8, the tool 40 is initially lowered through the casing 12 until the bottom of the tool 40 and the inlet ports 64 of the outer conduit 60 are disposed near the top of the open-hole section 30. At this time, the tool 40, drill pipe 22, and any extension on the end of the tool 40 (e.g., under-reamer 24) may be rotated in conjunction with the application of a working fluid from the surface that creates the suction through the inlet ports 64. As the cleaning process continues, the tool 40 may be lowered at a predetermined rate until the bottom of the tool 40 reaches the bottom of the open-hole section 30 within the well bore 10. See FIG. 9. Importantly, to maintain pressure isolation between the inlet ports 64 and outlet ports 68, the casing collar 46 on the top end of the tool 40 is not extended into the increased diameter open-hole section 30 of the well bore 10.

Since the casing collar 46 cannot extend into the open-hole section 30 of the well, the length of the tool 40 is adjustable to allow cleaning of the entire open-hole section 30. As will be appreciated, the length of the open-hole section 30 will vary from well to well depending on the thickness of the underlying coalbed(s) 20. Accordingly, for open-hole sections in thick coalbeds 20, the length of the tool 40 may be increased. In this regard, the first and second conduits 50, 60 of the tool 40 are sectional. That is, one or more sections may be added or removed from each conduit 50, 60 of the tool 40 to increase or decrease its length as necessary. In this regard, prior to completing or cleaning a well, an operator may adjust the length of the tool 40 in accordance with well log data.

In the embodiment shown, the working fluid utilized to clean the well (i.e. provided through drill pipe 22) is air. In this regard, for a standard methane gas well having a well casing diameter of 8", it has been found that 1,000 cfm of air at approximately 350 psi produces sufficient suction to effectively remove debris from the open-hole section 30 of the well during open-hole completion (e.g. under-reaming) and cleaning procedures.

The tool 40 may be utilized in a variety of different well contexts. Though discussed in relation to completion and/or cleaning of methane gas wells, which typically utilize an 8" steel well casing 12, the present invention may be utilized with other types of wells having differently size well bores 10. In this regard, one or more components of the well cleaning tool 40 may be sized to accommodate the differently sized well bores. For example, the size of the casing collar 46 may be increased for wells having larger well bores 10. Furthermore, the size (e.g., diameter) of the inner and outer ducts 50, 60 may be adjusted depending on their intended use (e.g., depending on a volume of fluid flow). What is important is that the inner and outer ducts 50, 60 are able to create a suction to draw debris into the tool 40 and expel that debris above the tool 40 for removal to the surface while the tool is interconnectable to the surface by a single conduit pipe.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method for removing debris from a well, comprising:

forming a barrier at a subterranean point of interest within a cased section of said well, wherein said barrier substantially isolates said well above and below said point of interest;

injecting fluid downward into said well through a first conduit extending from a surface source to an open hole section of said well beneath said barrier;

first discharging fluid from said first conduit into a second conduit extending into said open hole section of said well, wherein said first discharging step creates a suction for removing debris from said open hole section of said well beneath said barrier;

second discharging said fluid from said second conduit into said well at a position above said barrier, wherein said fluid and any said debris may continue upwardly to the surface.

2. The method of claim 1, further comprising:

rotating a drilling implement disposed below said barrier.

3. The method of claim 2, wherein rotating said drilling implement removes at least one of:

a sidewall material of said well wherein a diameter of a portion of said well is increased; and a bottom surface of said well, wherein the depth of said well is increased.

4. The method of claim 2, wherein in conjunction with said first discharging, a portion of said fluid is directed into said well beneath said barrier.

5. The method of claim 4, wherein said portion is directed through said drilling implement.

6. The method of claim 1, further comprising moving said barrier relative to said point of interest while removing said debris from said well.

7. The method of claim 1, wherein said forming a barrier step comprises forming a pressure barrier operative to support a pressure gradient across said barrier.

8. The method of claim 1, wherein said step of injecting comprises injecting a compressed gas into said well.

9. The method of claim 1, wherein said step of first discharging comprises discharging said fluid through a port having a reduced cross-sectional area relative to said first conduit to generate an area of low pressure.

* * * * *